US005244174A

United States Patent [19]

Moore

[11] Patent Number: 5,244,174

[45] Date of Patent: Sep. 14, 1993

[54] FRAME MEMBER

[75] Inventor: Edward Moore, L'Acadie, Canada

[73] Assignee: 2749394 Canada Inc., Montreal, Canada

[21] Appl. No.: 747,931

[22] Filed: Aug. 21, 1991

[51] Int. Cl.[5] ..... F16M 11/00

[52] U.S. Cl. ..... 248/188.8; 248/188.1

[58] Field of Search ..... 248/188.8, 188.1, 188.7; 72/158

[56] References Cited

U.S. PATENT DOCUMENTS

| | | | |
|---|---|---|---|
| 3,885,766 | 5/1975 | Resch et al. | 248/188.1 |
| 4,105,250 | 8/1978 | Caldwell | 248/188.7 X |
| 4,128,176 | 12/1978 | Green | 248/188.7 X |
| 4,169,625 | 10/1979 | Petersen | 248/188.7 X |
| 4,700,915 | 10/1987 | Killian | 248/188.1 |
| 4,722,503 | 2/1988 | Monahan | 248/188.8 X |

*Primary Examiner*—Alvin C. Chin-Shue

*Attorney, Agent, or Firm*—McFadden, Fincham, Marcus & Anissimoff

[57] ABSTRACT

A frame member, as is used for office and other furniture, such as desks, chairs and other components, is formed from a length of rigid tubing, of polygonal cross-section, and bent on a diagonal. The tube is bent by bending around an arcuate bending member having a peripheral groove which is a cross-section corresponding to about half the cross-section of the tube. The tube is gripped against the periphery of the arcuate bending member, by a gripping member, the bending member and gripping member moving about an axis to bend the tube. The tube is held in contact with the arcuate bending member by an elongate bending member which is slidingly supported on a fixed base and moves with the tube over the fixed base as bending progresses. The tube is supported against collapse by a stationary internal non-deformable member.

8 Claims, 4 Drawing Sheets

FRAME MEMBER

FIELD OF THE INVENTION

This invention relates to a frame member, and to apparatus for and a method of forming or bending a frame member.

BACKGROUND OF THE INVENTION

In chair and desk construction, frame members are frequently used in the form of tubular metal members such as tubes having a generally circular configuration. They have the advantage of light weight and in the case of tubular construction of a circular configuration, they may be bent to form corners or angles without collapsing the tube using known technology.

Desks and like articles are also constructed using rectangular or square tubing. Compared to circular tubing, rectangular tubing generally possesses higher strength characteristics and is more readily adaptable to a variety of construction features. When corners or angles are encountered in such furniture construction, various arrangements are used. For example the rectangular tubing is cut and either a corner adapter used or alternately, the tubing cut at a defined angle and welded to adjacent tubing at a similar angle. Another alternative is to bend the tubing against a flat face.

There are some situations where rectangular or other polygonally shaped tubing would be desirable, if it could be utilized in a manner similar to circular tubing where the latter is readily bent to be used around corners. While rectangular or square tubing can be bent by bending against the flat faces, one problem that has existed heretofore is that the rectangular or square tubing could not be bent on the diagonal so that it would present a uniform and aesthetically acceptable structure for use in furniture construction.

SUMMARY OF THE INVENTION

With the present invention, applicant has developed a novel frame member comprising rectangular or polygonally shaped metal material having a curve in which the frame member is bent on the diagonal whereby the frame member may be used in furniture and like construction where the furniture material, such as a desk top, may be mounted on the frame member on the diagonal.

An objection of the present invention is to provide a method of forming a curve in a rectangular or polygonally shaped member to provide a curved rectangular member in which the curve occurs on the diagonal.

A further object of the present invention is to provide apparatus for bending a polygonally shaped metal tube on a diagonal.

A still further object of the present invention is to provide a frame member comprising a length of rigid tubing having a pair of straight sections interconnected by curved section, each of said pair of straight sections having a free end, said curved section having an inner radius of curvature and an outer radius of curvature defined by a pair of opposed corners of said rigid material, each of said straight and curved sections having a cross-section substantially identical.

Yet another object of the present invention is to provide a method which comprises the steps of providing a length of rigid tubing, disposing said tubing on a diagonal relative to a planar substrate, inserting a rigid non-deformable member interiorly of said tubing, bending said tubing to form an angular displacement of the tubing relative to the other while said tubing is being bent along the diagonal line of the tubing and simultaneously withdrawing said rigid non-deformable member from said tubing at the point where said tubing is being bent and as the bend of the tubing progresses.

Another object of the invention is to provide an apparatus for bending a frame member of polygonal cross-section comprises a support base pivotally mounted for rotation about an axis, with an arcuate bending member mounted on the support base, the arcuate bending member having a peripheral groove extending in the periphery of the bending member. A gripping member adjustably mounted on the support base, being movable therewith, has a surface for engaging the tube and holding the tube against the arcuate bending member. On a fixed base, an elongate bending member is slidably supported and adjustable means are provided for supporting the elongate bending member against an unbent portion of a tube, the elongate bending member having a groove extending in one surface for engagement with a tube. A non-deformable member is provided for positioning between the arcuate bending member and the elongate bending member, with the end of the non-deformable member being positioned generally at the bending position. The non-deformable member is held against any longitudinal movement.

In greater detail of the present invention, the tubing may be any suitable rigid material of a metallic nature such as steel or steel alloy tubes, aluminum, brass, copper or the like. Typically, the tubing which will find the widest application will be rectangular or square tubing although the invention may also be used with pentagonally or hexagonally shaped tubing. In the case of most furniture construction, such as for desks, computer tables, printer stands or the like, the tubing will generally have a width ranged from ¼" to 2" or more and a height of from 14" to 3" or more. Typically, most rectangular tubing used in this area of constructions has a thickness which is sufficient to render itself supporting; the thickness will normally depend on the type of material and typically may fe from 1/16 to ⅜" or more.

It is a unique feature of the present invention that the tubing, bent on a diagonal, has a curved section with a pair of upwardly and inwardly tapering walls meeting at an apex, with each of the walls being substantially straight and with the curved portion of the tubing meeting straight sections of the tubing where the cross-section of each is substantially identical. In this way, smooth transitions from curved to straight sections are obtained which is structurally desirable and provides for a uniform and aesthetically acceptable frame member.

The frame members of the present invention are particularly suitable for constructing desks, computer tables and ancillary equipment such as printer tables. The bend on the diagonal tubing provides a unique appearance for the structures.

Having generally described the invention, reference will be made to accompanying drawings illustrating preferred embodiments.

DETAILED DESCRIPTION OF THE PREFERRED EMBODIMENTS

Figure 1:
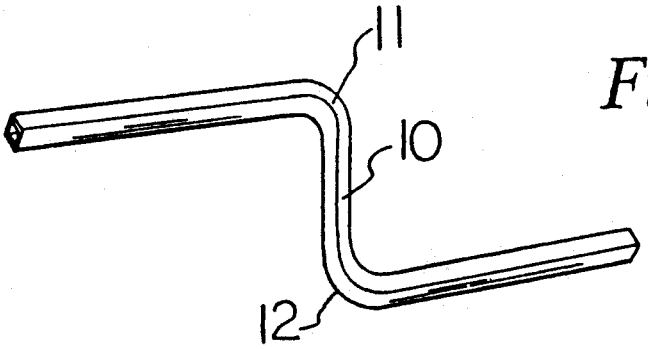
FIG. 1 is a perspective view of one example of a length of rectangular section tubing bent on a diagonal.

FIG. 1 illustrates a particular example of a bent tube 10 having a rectangular cross-section, in the example square cross-section, and bent on a diagonal at two positions 11 and 12. In the example the tube is bent in opposite directions at positions 11 and 12, but on the same diagonal.

Figure 2:
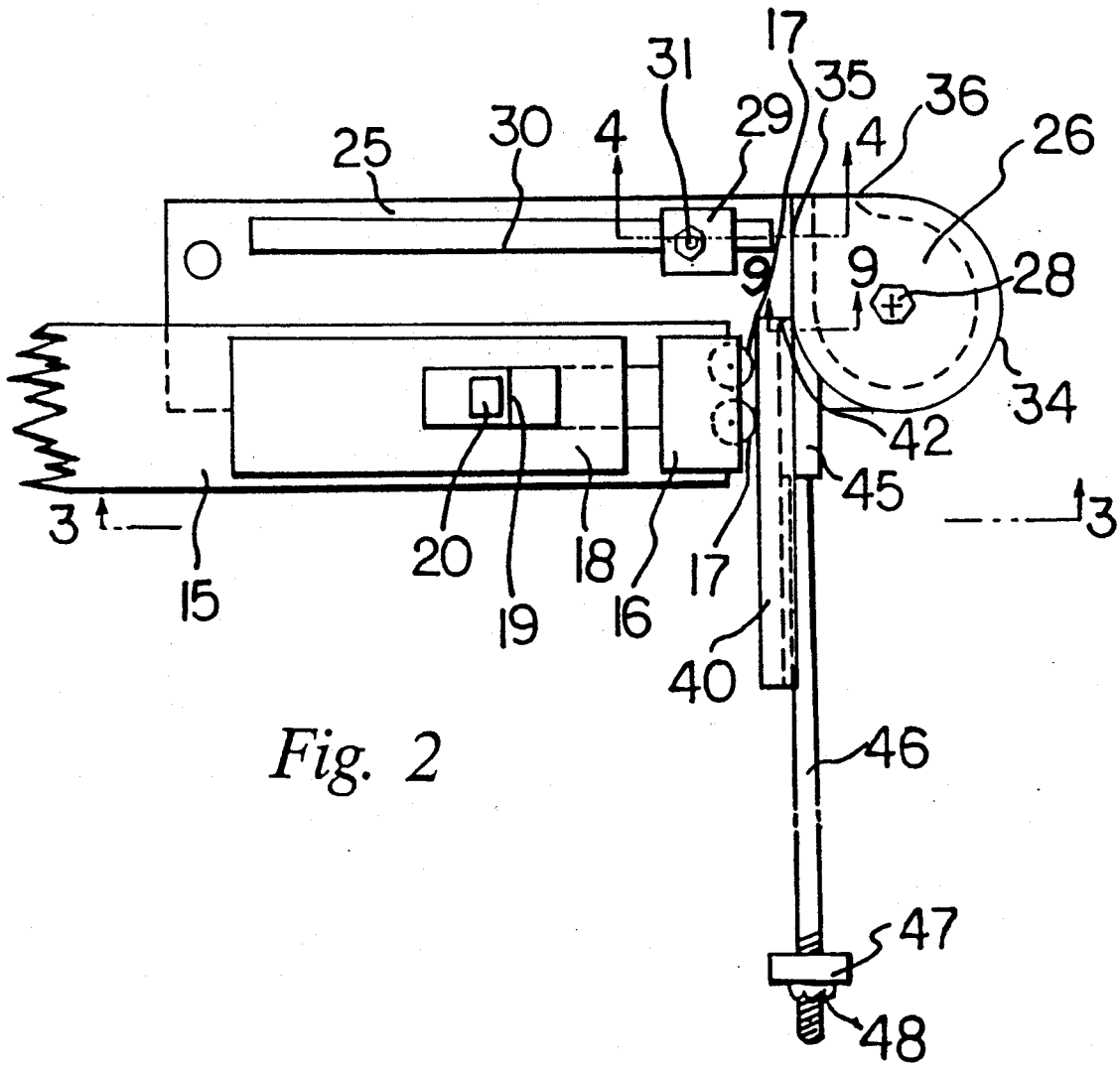
FIG. 2 is a top plan view of an apparatus for bending a rectangular section tube on a diagonal.
Figure 3:
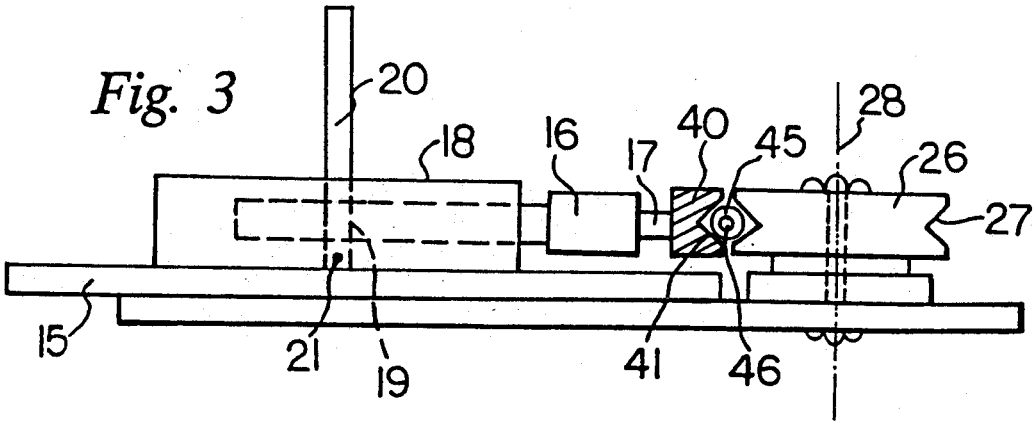
FIG. 3 is a cross-sectional view on the line 3—3 of FIG. 2.
Figure 4:
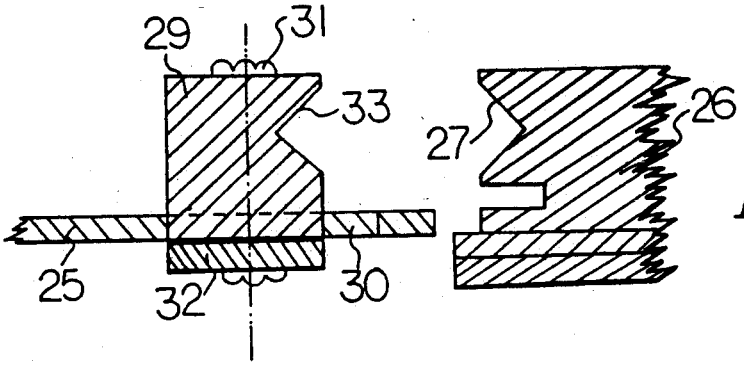
FIG. 4 is a cross-sectional view on the line 4—4 of FIG. 2.

FIGS. 2, 3 and 4 illustrate one form of apparatus for bending tubes as illustrated in FIG. 1. A fixed base 15 has mounted thereon an adjustable pressure member 16, having two rollers 17 pivotally mounted thereon. The pressure member is slidably supported in a support member 18 mounted on the base 15. The inner end of the pressure member 16 is acted upon by a lever 20, pivotally mounted at its base at 21 in the support member 18.

A pivotal base 25 carries at one end an arcuate bending member or die 26 which has a V-shaped groove 27 extending for a major part of its periphery. The base 25 and member 26 rotate or pivot about an axis 28. Slidably mounted on the pivotal base 25 is a gripping or forming member 29, which slides in a slot 30. The gripping member is clamped in position along the slot 30 by bolt 31 and a bottom plate 32—see FIG. 4. The gripping member 29 has a V-shaped groove 33 in its front face facing toward the V-shaped groove 27 in member 26.

As seen particularly in FIG. 2, the arcuate member 26, in the example, has a circular periphery 34 for approximately three quarters of the total periphery. The remainder is composed of two straight sections 35 and 36, the V-shaped groove 27 extending for section 35, which, in its prior to bending position, faces the gripping member 29.

Resting on the fixed base 15 is a rectangular sliding or following member 40. The member 40 slides against the rollers 17 and has a V-shaped groove 41 in the face facing away from the rollers. The member 40 can slide freely on the base 15. At the commencement of the bending cycle a forward end 42 of the member 40 is approximately at the junction of the circular periphery 34 and the straight section 35

Also seen in FIG. 2 and 3 is a non-deformable member or mandrel 45. In operation this mandrel fits inside a tube to prevent collapsing of the tube as it is bent. The mandrel 45, in the example, is cylindrical and is fastened to the end of a rod 46. The rod 46 extend to a holdfast 47, the rod being connected to the holdfast, for example by having a threaded end which passes through the holdfast and positioned by nut 48. Preferably the holdfast 47, while holding the rod 46 and mandrel 45 against axial movement as the tube is bent is free to move laterally, while the tube is being bent.

In use the rod 46 is passed through a length of tube to be bent, the end of the rod positioned in the holdfast 47. The rod is adjusted so that the outer end of the non-deformable member 45 is approximately at the same position as the end 42 of the sliding member 40. The tube is positioned over the rod 46 and member 45 so that the position at which the bend is to start is also at the same position at the end of the member 45. The gripping member 29 is then pushed against the tube to clamp it against the straight section 35. The apparatus is then ready for bending a tube.

Figure 5:
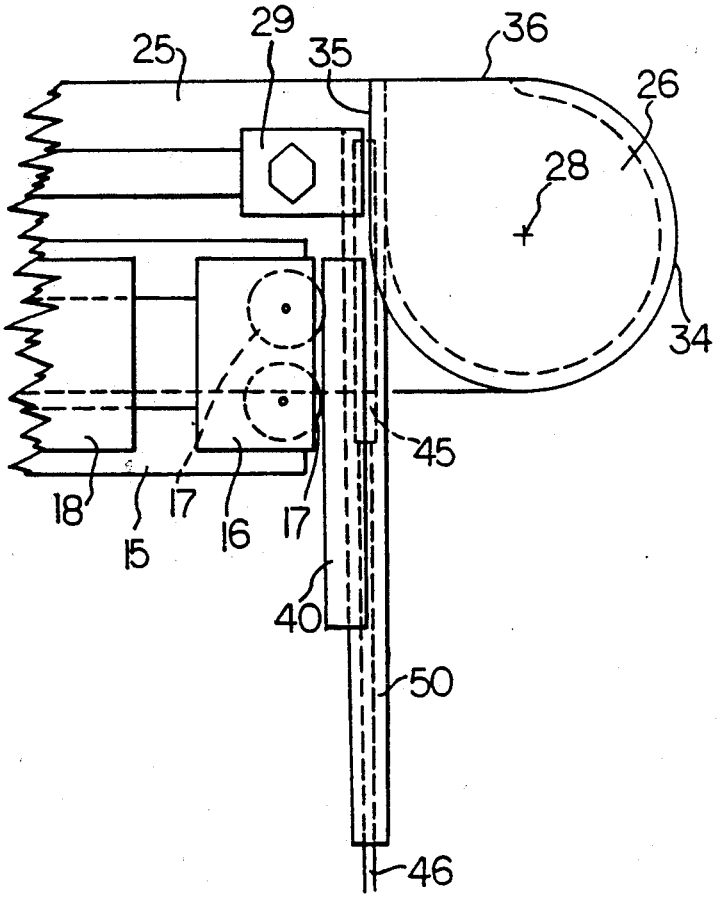
FIG. 5 is a top plan view of the main cooperative parts of the bending apparatus as in FIG. 2, to a larger scale, with a of tube in position prior to bending.

The bending member 26, and associated members 29, 16, 40 45 and 46 are illustrated in larger scale in FIG. 5, at the start of a bending cycle. A tube 50 is positioned ready for bending, gripped between the gripping member 29 and section 35 of the bending member 26, sliding member 40 is held against the tube by the member 16.

To bend the tube 50, the base 25 with the bending member 26 and the gripping member 29 is pivoted about the axis 28. This pulls the tube 50, together with the sliding member 40, over the non-deforming member 45. The tube is held on the diagonal between the sliding member 40 and the bending member 26 and bent around the periphery of the bending member 26 as this member pivots or rotates about the axis. The rod 46 and non-deformable member 45 are held against movement by the standfast 47.

Figure 6:
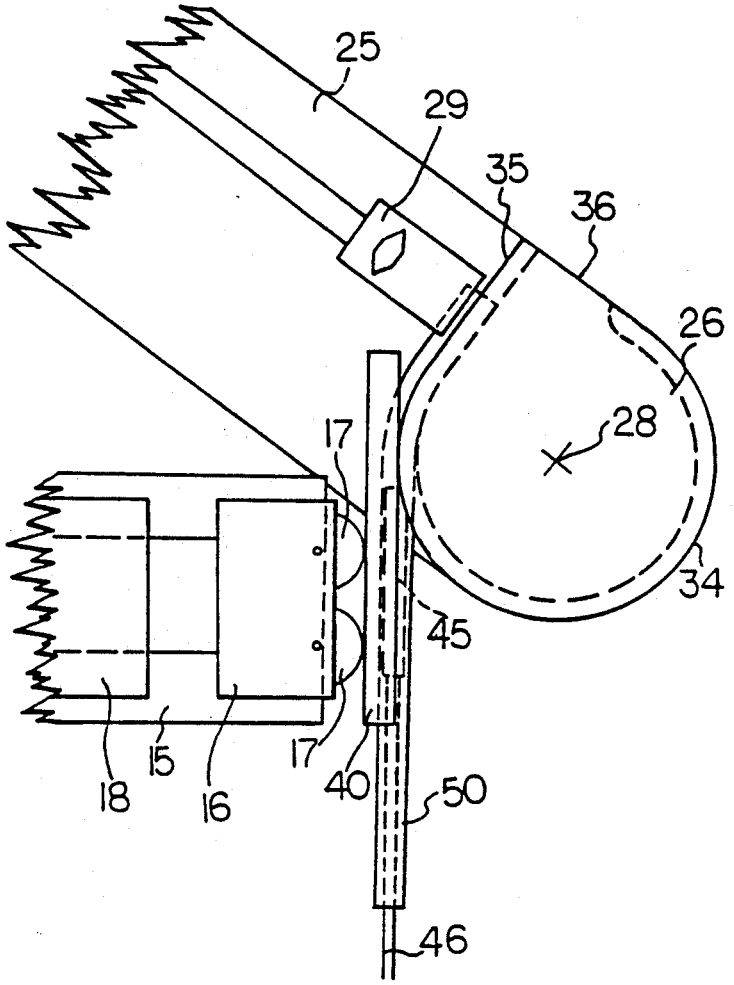
FIG. 6 illustrates the apparatus as in FIG. 5, showing the relative positioning of the cooperative parts part way through a bend.

FIG. 6 illustrates an intermediate bending position of the apparatus, the tube 50 having been bent through about 30°. The length of the sliding member 40 will depend upon the degree of bending of the tube, although a long member can be used for small and large bends. The apparatus as shown in FIGS. 2, 5 and 6 can provide bends up to about 270°.

Figure 7:
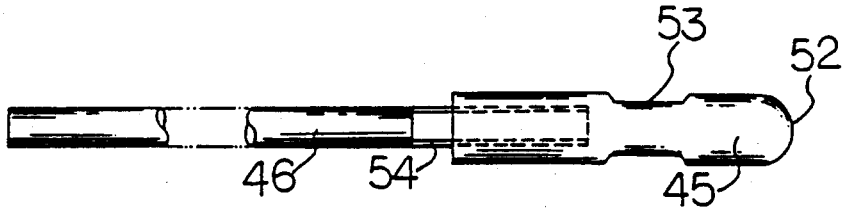
FIG. 7 is a plan view of a non-deformable member for positioning tube prior to bending.

FIG. 7 illustrates one form of non-deformable member 45 with the associated rod 46. As an example the member 45 is of a material having a low friction, such as polytetrafluoroethylene, sold under the trade mark Teflon. It is cylindrical in form and can have a rounded end 52 and can have a reduced diameter section 53. The member 45 is attached to the rod 46, for example by a threaded section 54 on the rod fitting in a threaded bore in the member 45.

Figure 8:
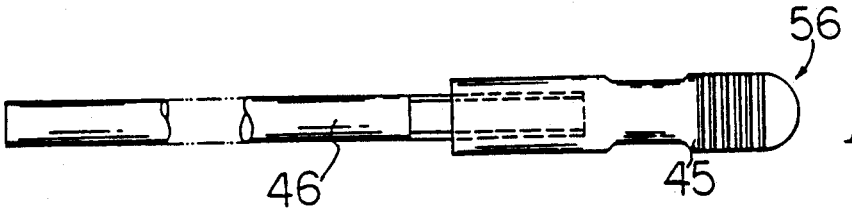
FIG. 8 is a plan view of an alternative form of a non-deformable member.

The end 52 of the member 45 requires fairly accurate positioning so that it does not extend into the actual bend in the tube, to avoid the member 45 being gripped in the bend. In an alternative form, at least the forward end portion of the member 45 can be of articulated form. This is illustrated in FIG. 8, where the forward end portion 56 is of several sections pivotally attached together. This will permit some slight entry of the member 45 into the bend but will enable the member to stay stationary while the tube moves over the member 45 as it is bent.

The arcuate bending member or die 26 is normally used for a variety of sizes of tube. Thus the member 26 is not changed when the size of the tube alters. The member 26 need only be changed when the radius of the bend is to be altered.

Figure 9:
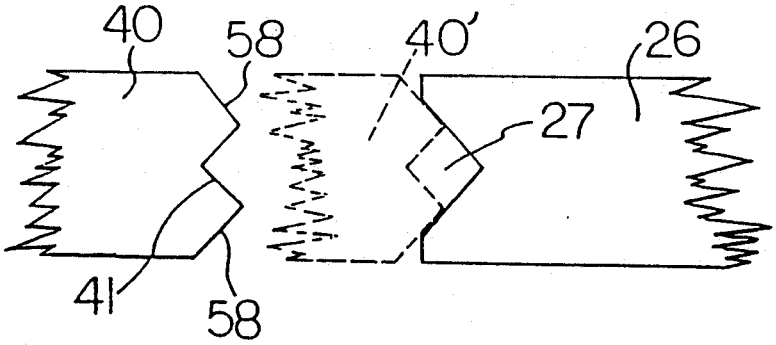
FIG. 9 is a cross-section, on the line 9—9 of FIG. 2, to a larger scale, illustrating bevelling of the edges of a sliding member.

The sliding or following member 40 can also be used with a variety of sizes of tube. To accommodate small sizes, the member 40 can have bevelled edges to fit into the V-shaped groove 27 of the bending member 26. This is illustrated in FIG. 9, which is a cross-section through a sliding member 40 and member 26. The edges of the member 40 are chamfered or bevelled at 58. By this means the member 40 can extend into the V-groove 27 in member 26, as indicated by the dotted outline 40'.

The gripping or forming member 29 changes with the size of tube being bent. The V-shaped groove 33 would normally be equal to half of the tube profile. This part can be very easily changed, being held by bolt 31.

The non-deformable member or mandrel 45 also changes with changes in size of the tube being bent, as it has to support the tube against collapse during bending. The non-deforming member 45 can be cylindrical, or may correspond to the internal cross-section of the tube being bent.

Figure 10:
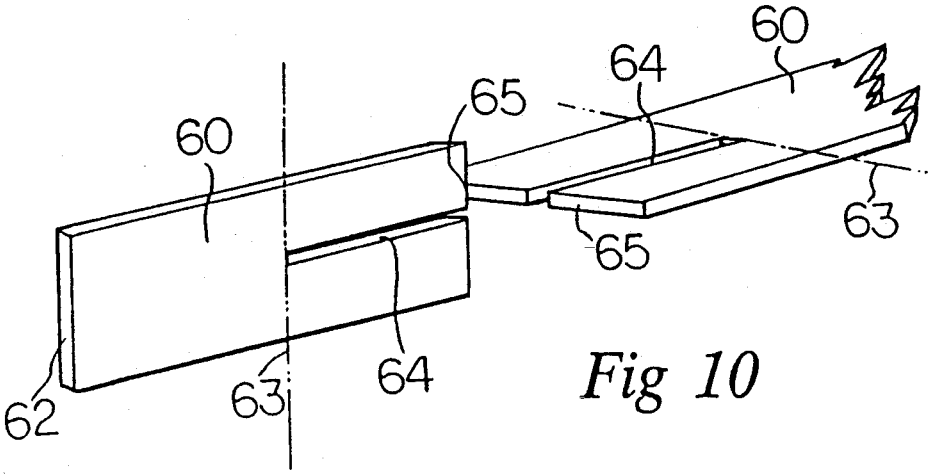
FIG. 10 is a perspective view of one form of joining member for joining tubes end to end.

FIG. 10 illustrates one form of a positioning and joining member which can be used to align two tubes end to end. The joining member comprises two elements 60 which are of the same form. An element 60 is an elongate piece of sheet material, for example metal. One end, which for example is identified as the rear end 62, is slightly tapered in width from an approximately central axis 63. The taper is inwards from the axis. Forward of the axis the element is parallel and is, for example, a close fit on a diagonal of a tube. A slot 64 extends in from the front end 65. The length of the slot is equal to half the length of an element, approximately.

One element 60 is pushed into one tube end until it becomes tight, that is when the tube end is approximately at the axis 63. Another element 60 is similarly inserted into another tube end. The elements are positioned so as to be at an angle to each other. In square tubes, the two elements will be normal to each other. With other polygon cross-sections the tube elements will be at some other relationship but will still work if some adjustment to the widths of the slots 64 is made. The two tubes are joined by bringing the tube ends together, the elements engaging along the slot 64. Eventually each slot 64 will engage over the unslotted portion of the associated element. When fully pushed together the tube ends will abut, approximately at the two axes 63.

Figure 11:
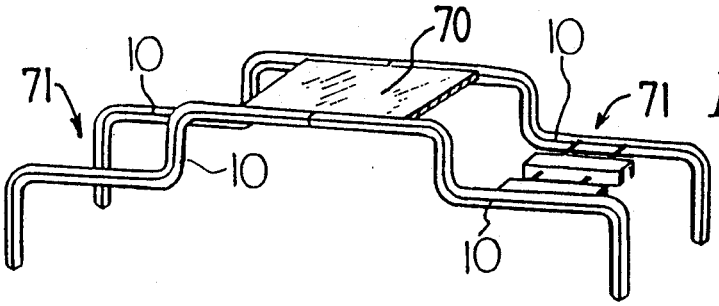
FIGS. 11 and 12 illustrate two of various forms of frame members, and frames using frame members, in accordance with the invention.
Figure 12:
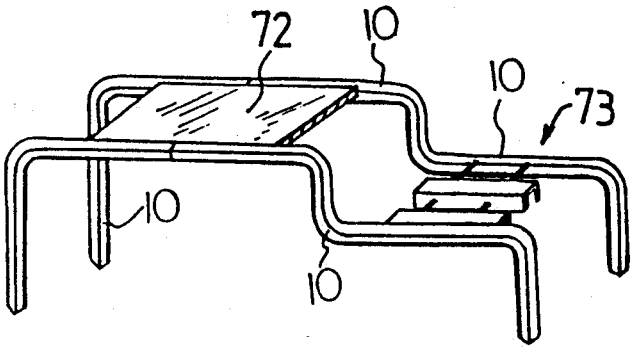

FIGS. 11 and 12 illustrate two forms of structure, such as office furniture, composed of bent tubes 10, in accordance with the present invention. In FIG. 11, there is a central portion 70, which could be a desk top, with two lower levels 71, one on each side. One level 71 could support a computer terminal for example. In FIG. 12, there is one portion 72, for example a desk top, and one lower level 73. Various other arrangements of support levels can be provided.

I claim:

1. A frame member comprising a length of rigid tubing of polygonal cross-section and having a pair of straight sections interconnected by a curved section, said curved section being bent in a plane extending through opposed corners and an inner radius of curvature and an outer radius of curvature defined by said opposed corners of said cross-section, each of said straight and curved sections having a cross-section substantially identical.

2. A frame member as defined in claim 1, wherein said length of tubing has a rectangular cross-section.

3. A frame member as defined in claim 1, said curved section having a pair of upwardly and inwardly tapering walls meeting at an apex, each of said straight and curved sections having a cross-section substantially identical.

4. A frame member as defined in claim 1, said length of rigid material having a base and a pair of upwardly and inwardly tapering walls extending from said base and intersecting at an apex, each of said straight and curved sections having a cross-section substantially identical.

5. A frame member as claimed in claim 1, having a plurality of curved sections, each curved section interconnecting a pair of straight sections.

6. A tubular structure for office furniture and similar items, comprising at least two spaced parallel frame members, each frame member comprising a length of rigid tubing of polygonal cross-section and having a pair of straight sections interconnected by a curved section, said curved section being bent in a plane extending through opposed corners and having an inner radius of curvature and an outer radius of curvature defined by said opposed corners of said cross-section, each of said straight and curved sections having a substantially identical cross-section.

7. A structure as claimed in claim 6, including at least two spaced parallel frame members comprising a length of rigid tubing of polygonal cross-section having a first pair of straight sections interconnected by a curved section, a second pair of straight sections interconnected by a curved section, said first and second pairs of straight sections interconnected by a further curved section, each said curved section being bent in a plane extending through opposed corners and having an inner radius of curvature and an outer radius of curvature defined by said opposed corners of said cross-section, each of said straight and curved section having a substantially identical cross-section.

8. A structure as claimed in claim 6, each pair of straight sections extending at right angles.

* * * * *